United States Patent [19]
Eide
[11] 4,318,196
[45] Mar. 9, 1982

[54] WHEEL ASSEMBLY FOR BOATS

[76] Inventor: Ralph M. Eide, P.O. Box 1554, Lake Oswego, Oreg. 97034

[21] Appl. No.: 135,448

[22] Filed: Mar. 31, 1980

[51] Int. Cl.[3] ..... B63C 13/00
[52] U.S. Cl. ..... 114/344; 280/414.2
[58] Field of Search ..... 9/1.2; 280/414 A; 248/642

[56] References Cited

U.S. PATENT DOCUMENTS 3,134,111 5/1964 Atwood ..... 9/1.2
3,765,369 10/1973 Henning ..... 248/642
4,036,507 7/1977 Henderson ..... 9/1.2

*Primary Examiner*—Sherman D. Basinger
*Attorney, Agent, or Firm*—Eugene M. Eckelman

[57] ABSTRACT

A pair of channel-shaped support members are arranged to be secured in upright position on the stern of a boat in spaced relation. These support members are open at their upper and lower ends with the end edges of such open ends being provided with notches. Strut members which support wheels at one of their ends have pivotal attachment at their other ends to the support members intermediate the ends of the latter. Each of the struts carries a transverse latch pin on it which is movable toward and away from the pivot connection of the struts with the support members and which is urged toward the pivot and by a tension spring. The arrangement is such that the latch pin automatically travels into one or the other of the end notches and locks therein when its strut is moved either to an up non-use position of the wheels or a down use position of the wheels. The end edges of the support members have a cam portion for directing the latch pins into the notches. The cross pins are elongated to provide handle portions for pulling them out of the notches for release.

3 Claims, 5 Drawing Figures

WHEEL ASSEMBLY FOR BOATS

BACKGROUND OF THE INVENTION

This invention relates to new and useful improvements in wheel assemblies for boats and particularly pertains to wheel assemblies for small car top boats and the like.

SUMMARY OF THE INVENTION

A primary objective of the present invention is to provide a wheel assembly for small boats that is arranged for attachment to the stern of the boat and which in particular has a convenient releasable latch connection for swinging a wheel strut to either an up non-use position or a down use position.

Another object of the invention is to provide a boat wheel assembly of the type described that is easy to install on a boat, that is simplified in operation, that is compact in structure, that is economical to manufacture, and that is arranged so as not to interfere with boat operation.

In carrying out the objectives of the invention, a pair of channel-shaped support members have means for securing them to the stern of a boat in spaced relation. The support members have open ends with notches in the end edges thereof, and wheel supporting struts which are pivotally attached at one of their ends to the respective support members are arranged to have latched engagement in the notches in either an up non-use positon or a down use position. Latching engagement of the wheel struts is provided by spring-pressed latch pins which automatically move into the notches along a tapered cam edge and which have projecting end portions readily engaged by the operator for releasing the pins from the notches.

The invention will be better understood and additional objects and advantages will become apparent from the following description taken in connection with the accompanying drawings.

DETAILED DESCRIPTION OF A PREFERRED EMBODIMENT

Figure 1:
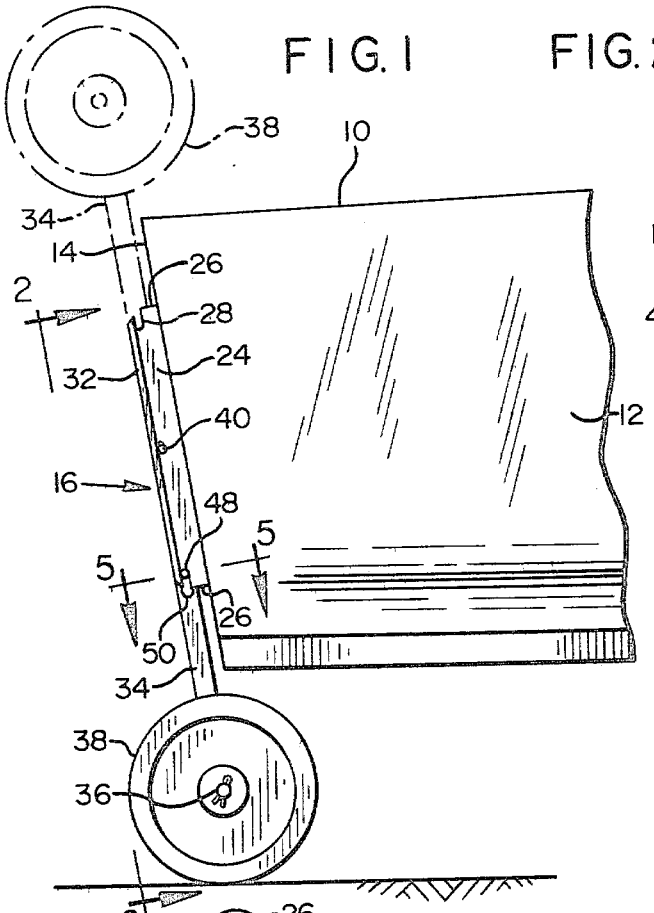
FIG. 1 is a side elevational view of the stern of a boat and showing a wheel assembly of the invention applied to the stern thereof.

With particular reference to the drawings, the numeral 10 designates a conventional boat of a somewhat small size such that it can be loaded on the top of a car or the like or at least of a size that frequently is not trailered and it is desired that the operator be assisted by wheel support for moving the boat from the transporting vehicle to the water and back. The numeral 12 designates the sides of the boat and the numeral 14 designates the transom. An outboard motor, now shown, is generally mounted centrally on the transom.

The wheel assembly of the invention comprises a channel-shaped support member or bracket 16 having a base or rear wall 18 with means 20, such as apertures, to receive bolts 22 or other conventional fasteners suitably securing the support member firmly to the transom of the boat in upright relation. Although only one wheel assembly is illustrated in the drawings, two of them generally will be used. Thus, support members 16 will be mounted in spaced relation on the transom and outward to the sides a distance sufficient so as not to interfere with the outboard motor.

The channel-shaped supporting members 16 include parallel side walls 24 having opposite end edges 26 each with longitudinally extending notches 28 intermediate the front and rear of the walls. A tapered cam edge 30 extends from the front edge of the walls to its notch 28 for a purpose to be described, the rear defining wall of the notches 28 projecting endwise in a wall portion **28*a* beyond the inner end of its cam edge 30. A reinforcing rib or thickness 32 extends longitudinally of the side walls 24 on each outer side thereof from the front end of the notches 28** to the front edge of the said walls.

A tubular strut 34 is dimensioned to fit in each of the channel-shaped support members 16 and these struts have an axle 36 mounted on one of their ends for supporting wheels 38. The other end of the struts 34 has a pivot connection to its support member 16 intermediate the ends of the latter by a pivot pin 40 centered longitudinally between the ends of the support member 16. Pivot pins 40 extend through aligned apertures 42 in the struts and in the members 16 and have a spring pressed latch ball 44 mounted therein adjacent one end which while firmly holding the pins in place allows them to be removed. The pins can be readily installed and removed by forcefully inserting them in place or pulling them out. Pins 40 have a finger engaging pull ring **40*a*** for easy installation and removal. Thus, the struts can be installed and removed by the operator as necessary and also this allows the assembly to be knocked down for shipment or storage.

Each strut 34 has a slide block 46 therein provided with an integral transverse latch pin 48 projecting beyond the sides of the block and extending through transversely aligned slots 50 in the side walls of the strut. Slots 50 are widened relative to the diameter of the pins 48 to allow free movement of the pins in the slots, the guided relation of the blocks in the struts maintaining the pins centered in their longitudinal movement in the slots and free of the side walls of the latter. The latch pin is urged toward the pivot point 40 by a tension spring 52 connected between the end of the strut 34 and a screw eye 54 on the latch pin guide block 46. The spring 52 holds the latch pin 48 against one end of the slot 50 in the unlatched position thereof.

Figure 4:
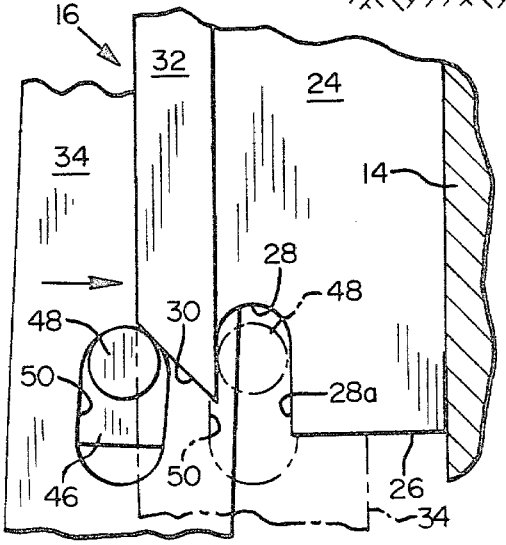
FIG. 4 is an enlarged fragmentary elevational view taken on the line 4—4 of FIG. 2.
Figure 5:
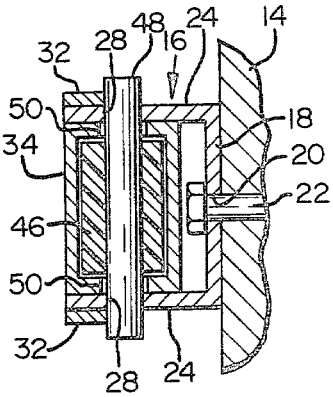
FIG. 5 is an enlarged fragmentary sectional view taken on the line 5—5 of FIG. 1.

When the wheel strut 34 is swung to an up or down direction, the latch pin 48 initially engages the tapered cam edge 30 on that end, as illustrated in full lines in FIG. 4. Upon further pivotal movement of the wheel strut, the pin 48 moves along such cam edge against the tension of spring 52 until it reaches the notch 28 whereby it will snap into such notch. Notch extension wall **28*a*** prevents any possibility of the latch pin from jumping over the notch.

Figure 2:
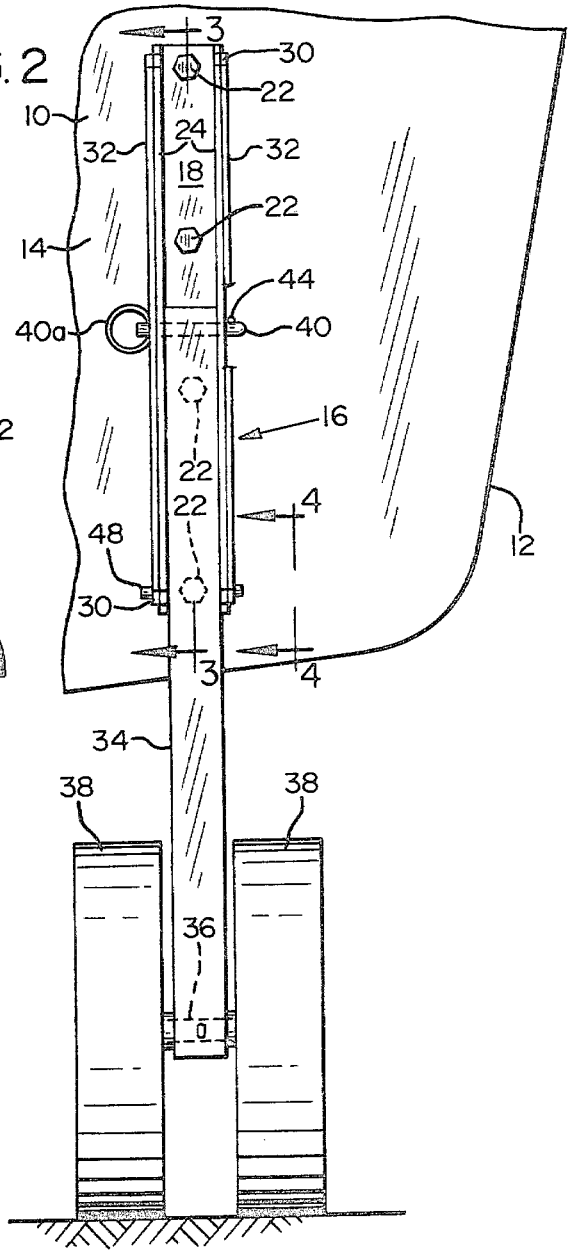
FIG. 2 is an enlarged rear elevational view of the wheel assembly taken on the line 2—2 of FIG. 1.
Figure 3:
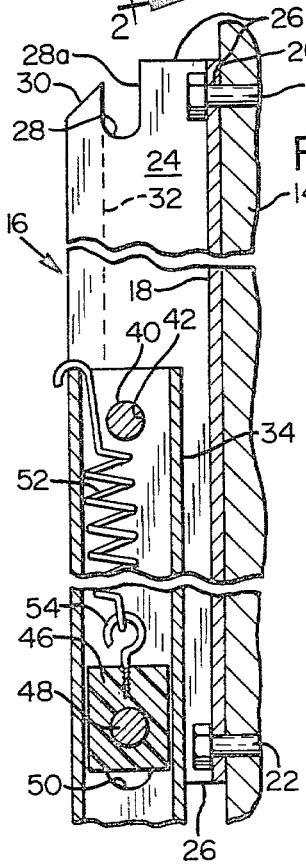
FIG. 3 is an enlarged fragmentary foreshortened sectional view taken on the line 3—3 of FIG. 2.

Latch pin 48 is of sufficient length relative to the width of the channel shaped support member 16 so as to project from both sides, as best seen in FIG. 2, whereby it can be grasped by the operator when it is desired that the latch be released from a notch 28 and the wheel strut rotated to its other position.

Thus, according to the invention, a boat wheel assembly is provided which is compact in structure and inexpensive to manufacture. Furthermore, as described above, the wheel automatically and conveniently locks in either one of its positions merely by pushing on the strut 34 or wheels with sufficient pressure to snap the latch pin 48 into the slots 28.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A wheel assembly for a boat comprising (a) a support member having a base wall and parallel projecting side walls forming a channel shape, (b) means on said support member arranged to secure it in upright position on the stern of a boat, (c) said support member being open at its upper and lower ends and said side walls terminating in end edges, (d) aligned notches in said end edges of the side walls at each end of said support member, (e) a wheel strut having opposite end portions, (f) wheel means on one end portion of said wheel strut, (g) the other end portion of said wheel strut extending into said channel-shaped support member, (h) transverse pivot means centrally located between the ends of said support member and connecting said other end portion of said wheel strut to said support member for pivotal movement of said wheel strut to up and down positions, (i) a transverse latch pin supported on said wheel strut intermediate the end portions thereof, (j) said latch pin being movable toward and away from said pivot means, (k) and spring means in said support member connected to said latch pin arranged to urge the latch pin toward said pivot means, (l) said latch pin being arranged when moved longitudinally of said support member against the action of said spring means to be received in one or the other of said end notches and held in locked relation therein by said spring means upon rotation of said wheel strut into an upper secured non-use position or a lowered secured use position, (m) each of said end notches of said support member having a tapered cam edge portion leading into its notches from the front of the support member for engagement by said latch pin and automatically directing it into said notches, (n) said latch pin extending through longitudinally elongated cross slots in said wheel strut to provide said movement thereof, (o) said pin being of elongated dimension relative to the cross dimension of said wheel strut and support member so as to project beyond the sides to provide manual engagement in releasing said pin from said notch.

2. The boat wheel assembly of claim 1 wherein the rear of said notches is defined by a wall which extends endwise beyond the tapered cam edges to form a stop for said latch pin in their engaging movement into said notches.

3. The boat wheel assembly of claim 1 wherein said side walls of said support member have a thickened reinforcing portion extending longitudinally along the sides adjacent the rear of said tapered cam edges.

* * * * *